United States Patent [19]

Akiyama et al.

[11] Patent Number: 4,705,224

[45] Date of Patent: Nov. 10, 1987

[54] APPARATUS FOR BLOWING A THREAD END OFF OF A FULL CHEESE FORMED BY AN OPEN-END SPINNING AND WINDING MACHINE

[75] Inventors: Shigeo Akiyama, Nishinomiya; Shigeji Satou, Okayama, both of Japan

[73] Assignee: Kurashiki Boseki Kabushiki Kaisha, Okayama, Japan

[21] Appl. No.: 918,104

[22] Filed: Oct. 14, 1986

[30] Foreign Application Priority Data

Oct. 14, 1985 [JP] Japan ..... 60-229378

[51] Int. Cl.[4] ..... B65H 54/22; B65H 67/06

[52] U.S. Cl. ..... 242/35.6 E; 242/35.5 A

[58] Field of Search ..... 242/35.6 E, 35.6 R, 242/35.5 R, 35.5 A, 18 R

[56] References Cited

U.S. PATENT DOCUMENTS

| | | | |
|---|---|---|---|
| 3,388,872 | 6/1968 | Kupper | 242/35.6 E |
| 3,441,230 | 4/1969 | Kupper | 242/35.6 E |
| 3,637,148 | 1/1972 | Kupper | 242/35.6 E |
| 3,913,853 | 10/1975 | Raasch | 242/35.5 A X |
| 4,103,836 | 8/1978 | Kupper | 242/35.6 E |
| 4,576,340 | 3/1986 | Aretz et al. | 242/35.6 E X |

*Primary Examiner*—Stanley N. Gilreath

*Attorney, Agent, or Firm*—Wenderoth, Lind & Ponack

[57] ABSTRACT

The invention is directed to an apparatus for blowing off a thread end from a full cheese formed by an open-end spinning and winding machine. The apparatus includes a pipe conduit which is provided midway along a transport path through which the full cheese passes. The pipe conduit is provided with a plurality of nozzles which inject high speed air from the inner surface of the pipe conduit toward the outer surface of the full cheese which is passing through the pipe conduit. The injected air causes the thread end to be raised from the full cheese surface and to flutter in back of the full cheese.

4 Claims, 6 Drawing Figures

APPARATUS FOR BLOWING A THREAD END OFF OF A FULL CHEESE FORMED BY AN OPEN-END SPINNING AND WINDING MACHINE

BACKGROUND OF THE INVENTION

1. Field of the Invention

The invention generally relates to an open-end spinning and winding machine and, particularly, to an apparatus for making a thread end noticeable and distinguishable from a reel of theads wound fully around a bobbin (hereinafter referred to as a full cheese) by the open-end spinning and winding machine. More specifically, the apparatus dislocates the direction and position of an end of a thread by blowing off the end of the thread wound at a certain angle with respect to the bobbin in the axial direction, thereof.

2. Description of the Prior Art

A thread spun by an open-end spinning and winding machine is wound around a bobbin to form a full cheese. As shown in FIG. 6, which is a side view showing a full cheese, a thread is wound around a bobbin 20 at angles $\alpha 1$ and $\alpha 2$ with respect to the axial direction of the bobbin 20. The angle $\alpha 1$ shown in FIG. 6, formed when the thread is wound around the bobbin 20 from left to right, is equal to the angle $\alpha 2$, formed when the thread is wound from right to left.

When a predetermined amount of thread is wound around the bobbin 20, (i.e., when a bobbin is full) a sliver, which is string-shaped fiber to be supplied to a spinning and winding machine as a material for the thread, is no longer supplied to the spinning and winding machine. The resulting thread wound tightly on the surface of a full cheese has a tapered end. The winding direction of the tapered end portion does not change, i.e., the tapered end portion lies in the winding direction at an angle of either $\alpha 1$ and $\alpha 2$.

A full cheese thus formed and removed from the spinning and winding machine is used for various purposes, including being fed to a warper. In this case, it is always necessary to lift a thread end from the surface of a full cheese.

Conventionally, workers have had to find the thread end and lift it from the full cheese. Since the thread end is tapered and the direction in which the tapered thead end lies is the same direction as the winding direction, it is extremely difficult and troublesome to distinguish the thread end on the surface of the full cheese, making the work of picking up the thread end difficult.

SUMMARY OF THE INVENTION

The invention has been developed in view of the disadvantage described above. It is therefore the object of the present invention to provide an apparatus which dislocates a thread end from a full cheese transported from an open-end spinning and winding machine so that the thread end can be found easily.

An apparatus according to the present invention comprises a pipe conduit which allows a full cheese, discharged and transported from an open-end spinning and winding machine, to pass therethrough and nozzles which inject high speed air from the inner surface of the pipe conduit toward the outer surface of the full cheese.

The pipe conduit is installed midway along the transport path of the full cheese. The inner diameter of the pipe conduit is configured to effect an air flow path, which maintains the speed of an air current injected from the nozzle, between the outer surface of the full cheese and the inner surface of the pipe conduit.

The nozzles are disposed at the exit side of the pipe conduit. The direction in which the high speed air is injected is the resultant direction opposite to the direction in which the full cheese is transported and the direction opposite to the direction in which the thread is wound on the full cheese.

According to an apparatus of the present invention, air is injected at a high speed from the nozzles toward the outer surface of a full cheese when it passes through a pipe conduit, while it is being transported. Since the injection direction of the high speed air is opposite to the thread winding direction, the injected air blows the thread end from the full cheese surface. Moreover, since the air injection direction is also opposite to the direction in which the full cheese is transported, the thread end which has been raised from the full cheese surface flutters backward from the full cheese (the direction in which the full cheese is transported being the front). In detail, the air swirls at high speed around the full cheese, with the result that the wound thread unwinds. If the pipe conduit has sufficient length, the thread end which has been raised from surface of the cheese is unwound and blown downwardly and rearwardly from the pipe conduit.

As set forth hereinabove, the end of a thread of the full cheese which was wound in a certain direction with respect to the axial direction of a bobbin is dislocated according to an apparatus of the present invention. Thus, the thread end can be distinguised from the wound thread of the full cheese and can be located easily.

BRIEF DESCRIPTION OF THE DRAWINGS

The object and features of the present invention will become apparent from the following description taken in conjunction with preferred embodiments thereof with reference to the accompanying drawings, throughout which like parts are designated by like reference numerals, and in which.

DESCRIPTION OF THE PREFERRED EMBODIMENTS

A preferred embodiment of the present invention will be described with reference to FIGS. 1 through 5.

Figure 1:
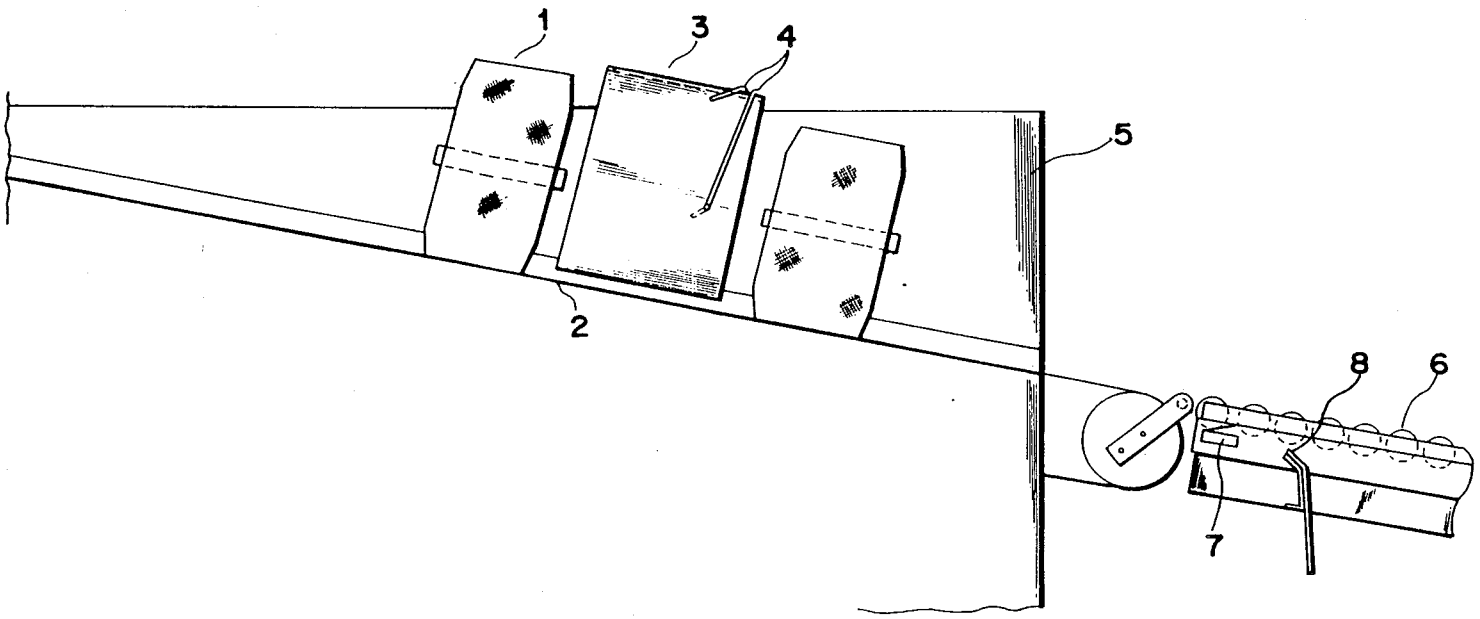
FIG. 1 is a side view showing a thread end blowing apparatus according to a preferred embodiment of the present invention which is mounted on an open-end spinning and winding machine.
Figure 2:
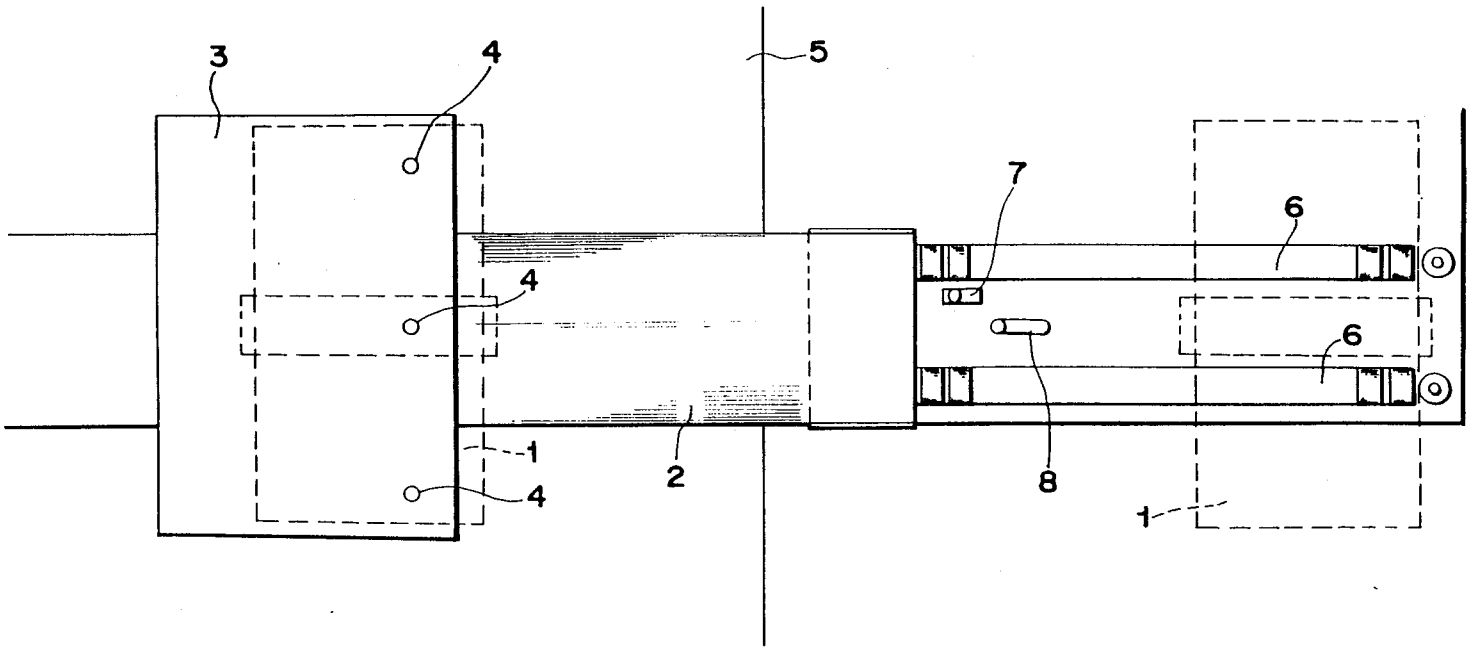
FIG. 2 is a plan view of the thread end blowing device.

FIG. 1 is a side view of an apparatus of the present invention installed on an open-end spinning and winding machine. FIG. 2 is a plan view of the apparatus. Referring to the drawings, numeral 1 shows a full cheese which is discharged from a spinning and winding machine (not shown) and transported by the belt conveyor 2. A short pipe 3 is disposed midway along the length of the belt conveyor 2. The short pipe 3 has nozzles 4 at the outlet side thereof which inject air at high speed. The belt conveyor 2 extends to the end of the spinning and winding machine table 5. A roller conveyor 6 is connected to the right end of the belt conveyor 2, as shown in FIGS. 1 and 2, to further transport the full cheese. As shown in FIG. 2, roller conveyors 6 are provided in two rows. The distance between one roller conveyor 6 and the other conveyor 6 is the same as the width of the belt conveyor 2. In the drawings, numeral 7 designates a sensor which detects the full cheese 1 when it is placed on the roller conveyor 6. Numeral 8 designates a nozzle which injects air at high speed from a position proximate the center of the roller conveyor 6 upward toward the full bobbin cheese 1 in a direction opposite to the direction in which the full cheese is transported in response to a signal transmitted from the sensor 7.

Figure 3:
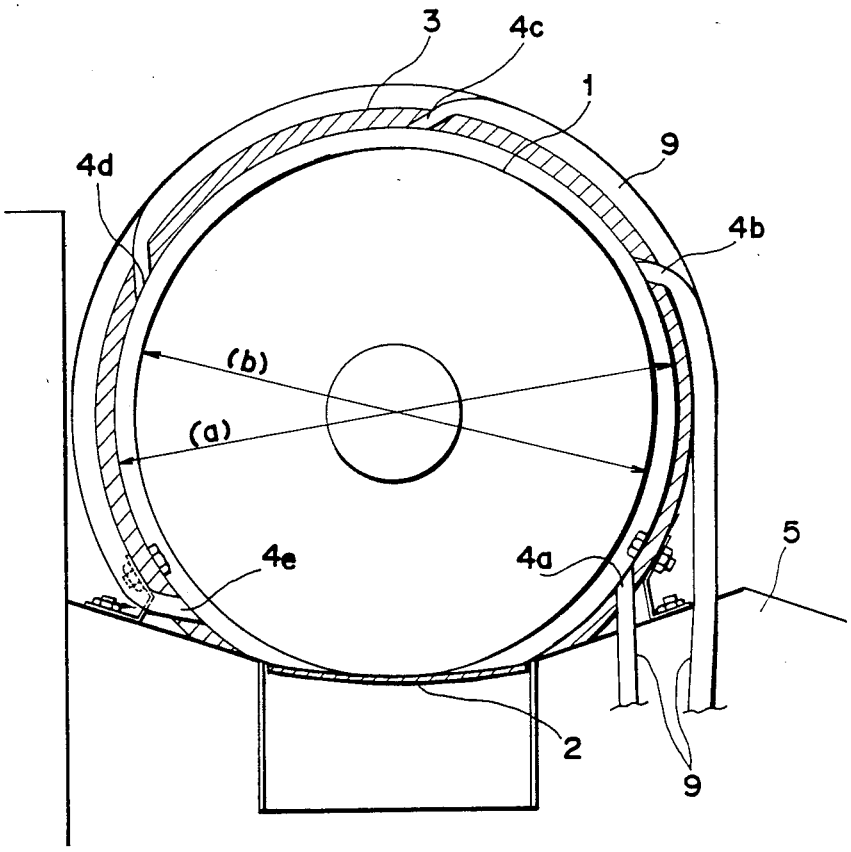
FIG. 3 is an enlarged sectional view of the principal portion of the apparatus shown in FIG. 1.

FIG. 3 is an enlarged sectional view showing the principal portions of the short pipe 3 and the nozzle 4. The short pipe 3 has an open section at the bottom portion thereof which would otherwise be brought into contact with the belt conveyor 2, and is mounted on the spinning and winding machine table 5 so as to form a tunnel on the transport path. The inner diameter (a) of the short pipe 3 is large enough for the full cheese 1 to pass through it on the conveyor 2. It is dimensioned to allow a passage of the full cheese 1 considering the possibility of formation of full cheeses having large diameters. Moreover, the inner diameter (a) of the short pipe 3 is larger than the outer diameter (b) of the full cheese so that the flow speed of high speed air which is described below is fast enough to blow off the thread end on the full cheese 1.

The nozzles 4 are provided at the inner face of the short pipe 3 circumferentially thereof at equal intervals. Five nozzles 4 are mounted on the short pipe 3, in this embodiment. The nozzles 4, respectively connected to high pressure supplying pipes 9, which are mounted around the outer periphery of the short pipe 3, penetrate the outer wall of the short pipe 3 and extend to the inner surface of the short pipe 3. High speed air injected from each nozzle 4 swirls around the outer surface of the full cheese 1 which passes through the short pipe 3, i.e., the high speed air is injected from the nozzles 4 in a direction opposite to not only the thread winding direction, namely, conterclockwise, but also to the direction in which the full cheese 1 is carried, namely, from the exit side of the short pipe 3 to its entrance side. In this embodiment, nozzles 4 are numbered 4*a*, 4*b*, 4*c*, 4*d*, and 4*e* counterclockwise from the lower right.

Figure 4:
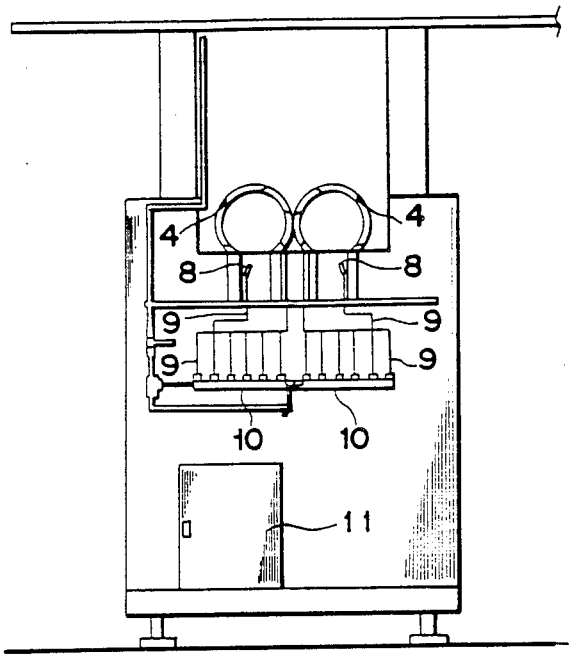
FIG. 4 illustrates the outline of the peripheral structure of the apparatus shown in FIG. 1.
Figure 5:
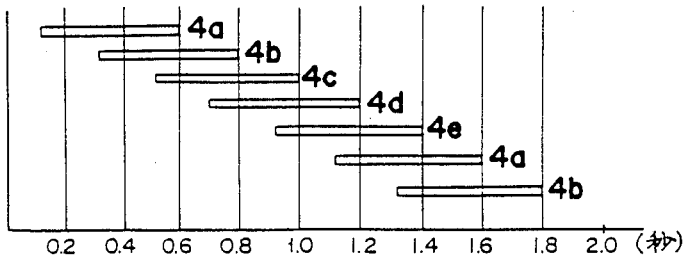
FIG. 5 is a time chart of high speed air injection facilitated by each nozzle shown in FIG. 3.
Figure 6:
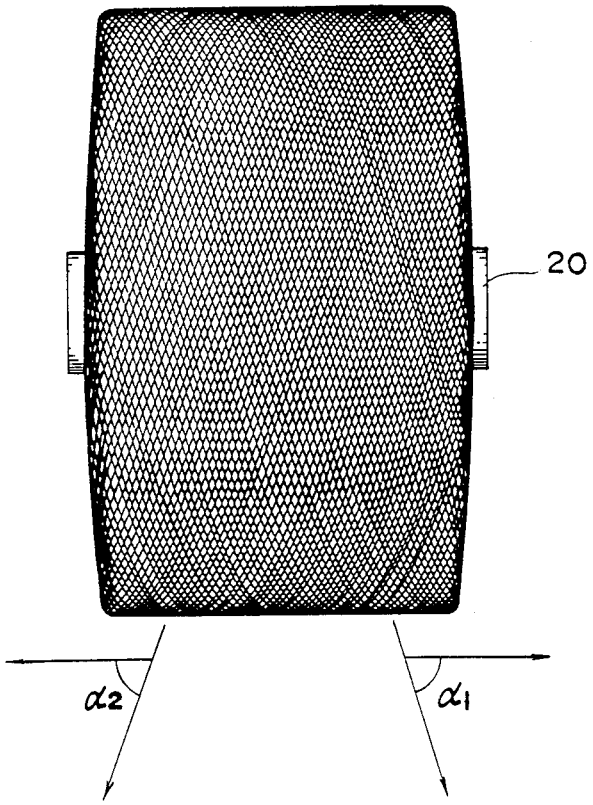
FIG. 6 is a side view of a full cheese which is made by an open-end spinning and winding machine, as previously described.

FIG. 4 schematically illustrates the peripheral structure of an apparatus of the present invention installed on a spinning and winding machine having two respective transport paths. A respective apparatus according to the present invention is installed on each transport path as shown in this drawing. Nozzles 4 and 8 are connected to their corresponding highly pressurized air supplying pipes 9, respectively. The highly pressurized air supplying pipes 9 are connected to electromagnetic valves 10 which have a function of distributing highly pressurized air. A compressor (not shown) supplies highly pressurized air to the electromagnetic valves 10. Valves which correspond to each nozzle 4*a*, 4*b*, 4*c*, 4*d*, and 4*e* open and close repeatedly and sequentially at a predetermined time cycle. FIG. 5 is a graph showing the injection time cycle of each nozzle. The nozzle 4*a* injects highly pressurized air for 0.5 seconds. The nozzle 4*b* starts injection 0.2 seconds after the nozzle 4*a* has started injection. Other nozzles perform sequential injection in the same manner. The control box 11 shown in FIG. 4 controls the injection cycle. It is possible to start injection by the nozzles simultaneously. In this case, however, it is necessary to install a pressure tank or a compressor having a high output capacity. Sequential injection is more suitable than simultaneous injection because it causes the high speed air current to be more turbulent and thus ensures the blowing-off of the thread end. The electromagnetic valve 10, which corresponds to the nozzle 8 opens and closes in response to the signal transmitted from the sensor 7. The nozzle 8 is provided to blow off a thread end on the roller conveyor 6 when the thread end on the full cheese 1 fails to be blown off by the nozzle 4 if for instance the thread end is sandwiched between the full cheese 1 and the belt conveyor 2.

In this embodiment, when the full cheese 1 passes through the short pipe 3 while it is being transported by the belt conveyor 2, high speed air injected from the nozzles 4 swirls around the outer surface of the full cheese 1. The end of the thread which has been tightly wound on the surface of the full cheese 1 is raised from the surface of the full cheese, thus fluttering toward the back of the short pipe 3 due to the current which is swirling.

In this embodiment, part of the short pipe 3 is open at the portion where the short pipe 3 would otherwise come in contact with the belt conveyor 2. If the full cheese 1 is transported without being brought into contact with the belt conveyor 2, a short circular pipe may be used without a lower portion thereof being open. In this case, the nozzles 4 alone can reliably blow off the thread end, so that the need for providing the nozzle 8, which compensates for the failure of blowing-off the thread end, is eliminated. The invention may be embodied by the tandem provision of two apparatuses on the transport path so as to blow off a thread end reliably by rotating a full cheese at a certain angle when it moves from one apparatus to the other.

What is claimed is:

1. An apparatus for blowing a thread end off of a full cheese on which the thread is disposed in a winding direction as the full cheese is discharged in a transport direction along a transport path defined on an open-end spinning and winding machine which has formed the full cheese, said apparatus comprising:

a pipe conduit disposed in the transport path and through which the full cheese passes, said pipe conduit having an inner diameter that is larger than the outer diameter of the full cheese for allowing the full cheese to pass therethrough with a space defined therebetween, said pipe conduit having an entrance side through which the full cheese enters when passing therethrough and an exit side through which the full cheese exits after passing therethrough, and said pipe conduit having a plurality of nozzles disposed at said exit side and open at the inner surface thereof for injecting air at a high speed from the inner surface and through said space to the outer surface of the full cheese in a direction opposite to the transport direction and the winding direction to blow the thread end off of the full cheese.

2. An apparatus as claimed in claim 1, wherein said plurality of nozzles are spaced apart from one another along the inner surface of the pipe conduit at substantially equal intervals.

3. An apparatus as claimed in claim 1, and further comprising a belt conveyor for discharging the full cheese along the transport path.

4. An apparatus as claimed in claim 3, wherein said pipe conduit has an open portion at the bottom thereof through which said belt conveyor passes.

* * * * *